US009596532B2

(12) United States Patent
Rye

(10) Patent No.: US 9,596,532 B2
(45) Date of Patent: Mar. 14, 2017

(54) HEADPHONE DEVICE AND A KNUCKLE FOR FACILITATING AN ADJUSTABLE CONNECTION BETWEEN AN EAR POD AND HEADBAND

(71) Applicant: Motorola Mobility LLC, Chicago, IL (US)

(72) Inventor: Ryan P Rye, Lawrenceville, GA (US)

(73) Assignee: Motorola Mobility LLC, Chicago, IL (US)

( * ) Notice: Subject to any disclaimer, the term of this patent is extended or adjusted under 35 U.S.C. 154(b) by 72 days.

(21) Appl. No.: 14/641,596

(22) Filed: Mar. 9, 2015

(65) Prior Publication Data

US 2016/0269814 A1 Sep. 15, 2016

(51) Int. Cl.
*H04R 1/10* (2006.01)

(52) U.S. Cl.
CPC ..... *H04R 1/105* (2013.01); *H04R 1/1066* (2013.01)

(58) Field of Classification Search
CPC ..... H04R 1/1066; A61F 11/14
See application file for complete search history.

(56) References Cited

U.S. PATENT DOCUMENTS 4,027,113 A * 5/1977 Matsumoto ..... F16C 11/0661 381/370
2003/0210801 A1 11/2003 Naksen et al.
2004/0154082 A1* 8/2004 Saffran ..... A61F 11/14 2/423
2010/0034414 A1 2/2010 Miyata

FOREIGN PATENT DOCUMENTS

CH 661202 A * 7/1983

* cited by examiner

*Primary Examiner* — Matthew Eason
(74) *Attorney, Agent, or Firm* — Watson Intellectual Property Group

(57) ABSTRACT

The present invention provides a knuckle for facilitating an adjustable connection between an ear pod and a headband, and/or a headphone device. The knuckle includes a first end slidably coupled to the headband, the first end being adapted for being received within and traveling along a slot in the headband. The knuckle further includes a second end rotatably coupled to the ear pod proximate the point along the slot that the first end of the knuckle is currently located.

19 Claims, 8 Drawing Sheets

HEADPHONE DEVICE AND A KNUCKLE FOR FACILITATING AN ADJUSTABLE CONNECTION BETWEEN AN EAR POD AND HEADBAND

FIELD OF THE INVENTION

The present invention relates generally to adjustable headphone sets, and more particularly, to a knuckle for facilitating an adjustable connection between an ear pod and a headband.

BACKGROUND OF THE INVENTION

Headphones are adapted for reproducing an audio signal from a device, where the audio signal is generally provided to a user in a semiprivate manner with the sound reproducing elements being proximate the user's ear(s). The semiprivate nature can be used for privacy and/or for preventing the produced sound from disturbing others that might be nearby. In some instances a single audio signal will be reproduced at one or both of the user's ears. In other instances a pair of related signals corresponding to a stereo audio signal will each be respectively produced at alternative ones of the user's ears.

In order for the sound producing elements to be maintained proximate the one or more ears of the user, the headphones will often provide additional structure which helps to locate the sound producing elements relative to the head of the user. This can often involve a headband which extends between the sound producing elements. However because everyone's head is different, this can additionally involve one or more forms of adjustment, so as to more comfortably position the sound producing elements proximate the ears of the user. For example, common forms of adjustment include a mechanism for adjusting the length of the headband that is located between the sound producing elements, as well as one or more adjustments to allow some degree of movement of the sound producing elements relative to the side of the head of the user, proximate the respective ear. The sound producing elements are sometimes located within corresponding ear pods.

In at least some instances where adjustable bands have been used, the ear pods are generally fixed relative to each end of the band. In turn the band itself can be adjusted to be longer or shorter, where in at least some instances a section of the band is allowed to move between a more or less overlapping position relative to another section of the band, such as along a metal guide. In such instances, each section of the band is commonly comprised of at least two housing elements. When the band has three sections (i.e. center, adjustable left side, and adjustable right side), the entire band will generally include at least six housing elements, which makes for a relatively complex assembly. Furthermore, where the ear pods are fixed relative to the respective end of the band, any adjustment of the ear pod would need to be accomplished through separate additional structure. Still further the routing of any wired connection between the respective ear pods can be complicated by an adjustable band, where the sections are allowed to selectively overlap varying amounts.

Correspondingly, the present inventors have recognized that it would be beneficial to manage the adjustment of a headphones relative to the head of the user, by coupling ear pods to respective ends of a headband via a knuckle which can be slidably coupled to the same, such as within a slot. Further adjustment is possible via the knuckle at the point of coupling by allowing the ear pods to rotate with respect to the knuckle, which allows for a rotational coupling and a slidable coupling for multiple forms of adjustment via the knuckle.

SUMMARY OF THE INVENTION

The present invention provides a headphone device including a headband, and one or more ear pods. Each of said ear pods is coupled to the headband via a joint. The joint includes a knuckle having a first end and a second end, where the first end of the knuckle is slidably coupled to the headband, and the second end of the knuckle is rotatably coupled to the respective ear pod. The headband includes a respective slot within which the first end of each of the knuckles is received and along which the knuckle travels.

In at least one embodiment, the second end of the knuckle is captivated within a space inside the ear pod, where in at least some instances the space inside the ear pod can be formed between an ear pod base and an ear pod cover. For example, a notch in the knuckle is adapted and arranged to interact with a protrusion formed in the ear pod base, and where the notch is sized relative to the size of the protrusion, so as to allow a degree of rotation of the ear pod and correspondingly movement of the protrusion within the notch.

In at least a further embodiment, the knuckle at the second end has an end facing which, when the knuckle is rotatably coupled to the ear pod, has a gap between the end facing of the second end of the knuckle end and the ear pod base, wherein the gap allows the ear pod to tilt relative to the knuckle.

The present invention further provides a knuckle for facilitating an adjustable connection between an ear pod and a headband of a headphone device. The knuckle includes a first end slidably coupled to the headband, the first end being adapted for being received within and traveling along a slot in the headband. The knuckle further includes a second end rotatably coupled to the ear pod proximate the point along the slot that the first end of the knuckle is currently located.

These and other objects, features, and advantages of this invention are evident from the following description of one or more preferred embodiments of this invention, with reference to the accompanying drawings.

DETAILED DESCRIPTION OF THE PREFERRED EMBODIMENT(S)

Figure 1:
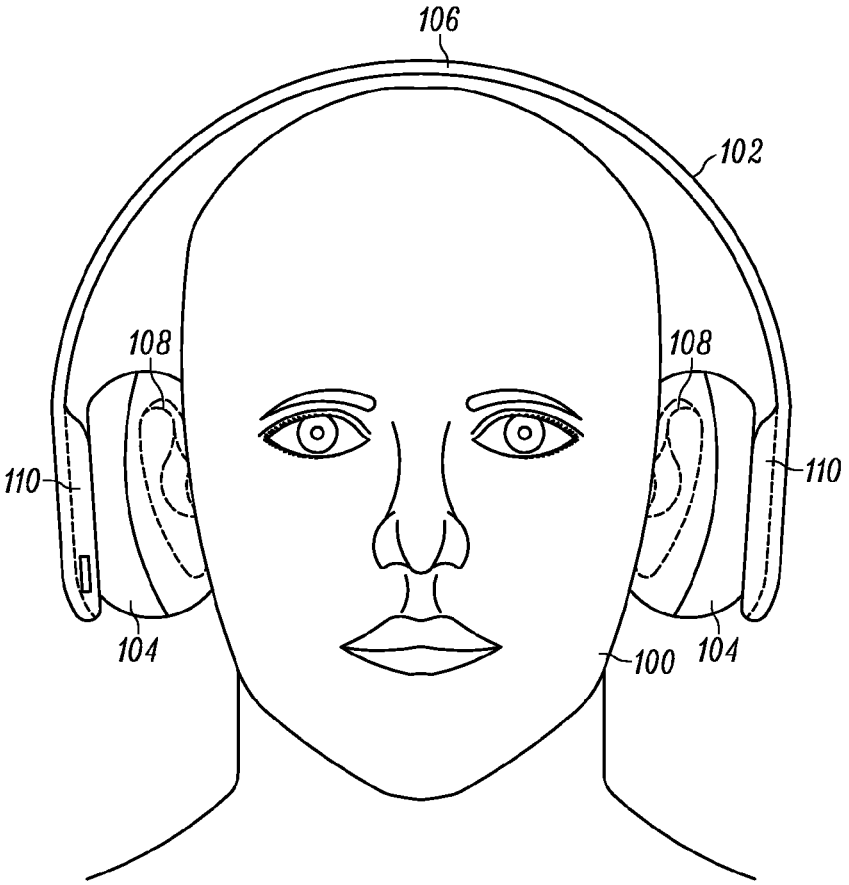
FIG. 1 is a front view of the head of a user, wearing an exemplary headphone set.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

FIG. 1 illustrates a front view of the head of a user 100, wearing an exemplary headphone set 102. The headphone set includes a pair of ear pods 104, and a headband 106. The ear pods 104 are coupled to the headband proximate respective ends of the headband 106. The ear pods 104 are adapted to cover at least partially respective ears 108 of the user 100, where the ear pods each can have sound producing elements adapted to receive an electronic signal, and produce an audio signal toward the corresponding ear 108. The ear pods 104 are connected to the headband 106 via respective headband end covers 110. Depending upon the point of coupling of the ear pod 104 to the headband 106, via the headband end cover 110, the effective length of the headband 106 between the ear pods 104 can be adjusted. By adjusting the effective length of the headband 106, the headphone set 102 can be adjusted so as to accommodate a comfortable fit of the headphone set 102 relative to the head of the user 100.

Figure 2:
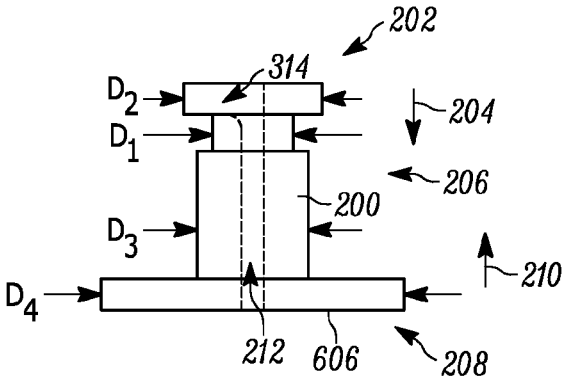
FIG. 2 is a side view of an exemplary knuckle for facilitating an adjustable connection between an ear pod and headband, in accordance with at least one aspect of the present invention.
Figure 3:
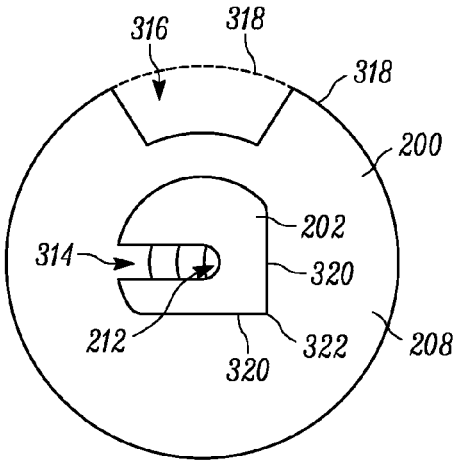
FIG. 3 is a top view of the knuckle, illustrated in FIG. 2.

More specifically, in accordance with at least one embodiment of the present invention, each of the respective ear pods 104 will couple to a corresponding end of the headband 106, via a knuckle, illustrated in FIGS. 2-3. The knuckle is adapted to slidably couple to the headband end cover 110, and rotatably couple to the ear pod 104.

FIG. 2 illustrates a side view, and FIG. 3 a top view, of an exemplary knuckle 200 for facilitating an adjustable connection between an ear pod 104 and headband 106, in accordance with at least one aspect of the present invention. The knuckle 200 includes at a first end 202 having a varying diameter, where the size of the diameter $D_1$ of the knuckle toward 204 the center 206 at the first end 202 of the knuckle 200 is smaller than the diameter $D_2$ of the knuckle at the first end 202 of the knuckle 200 further away from the center 206. The knuckle 200 additionally includes at a second end 208 a varying diameter, where the size of the diameter $D_3$ toward 210 the center 206 at the second end 208 of the knuckle 200 is smaller than the diameter $D_4$ of the knuckle at the second end 208 of the knuckle 200 further away from the center 206. In at least the illustrated embodiment, the diameter $D_3$ is larger than the diameter $D_1$.

The knuckle 200 includes a pathway 212 which extends from the first end 202 of the knuckle 200 through to the second end 208 of the knuckle 200. The pathway 212 allows for the routing of a signal conductor, such as a wire, through the knuckle 200. In at least some instances, the knuckle 200 at the first end 202 in the area proximate the diameter $D_2$ includes a slot 314, which extends from the pathway 212 to one of the side edges of the knuckle 200. The knuckle 200 in the illustrated embodiment additionally includes a notch 316, which extends from an outer edge 318 of the maximum outer dimension proximate the second end 208. The notch 316 extends from the outer edge toward the center of the knuckle 200. In some instances, the outer edge will be an outer circumference. However, the outer edge need not be circular in nature.

While in at least some instances, the knuckle will be comprised of multiple stacked generally cylindrical shapes of varying diameters, the cross-sectional shapes of the stacked structure similarly need not be constrained to being circular in nature, and in fact will likely deviate at some points between the first and the second ends. For example as noted above toward the second end 208, the knuckle 200 can include a notch 316, which will vary the cross sectional shape. Additionally, in at least the illustrated embodiment, toward the first end 202, adjacent outer edges 320 are flattened to square off and form a more corner-like 322 contour.

Figure 4:
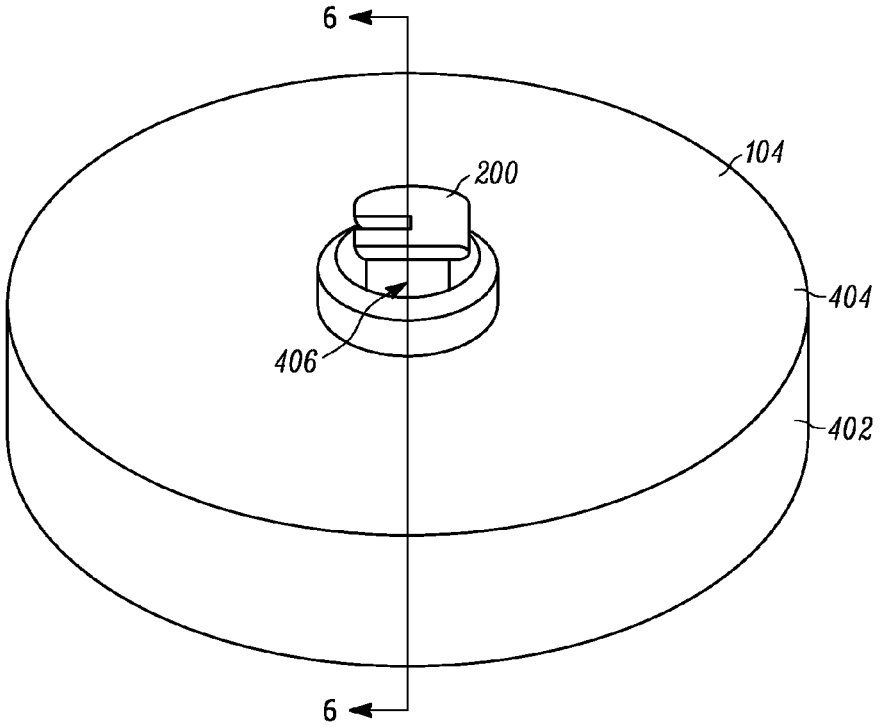
FIG. 4 is a perspective view of an ear pod, coupled to the knuckle illustrated in FIGS. 2 and 3.

FIG. 4 illustrates a perspective view of an ear pod 104, coupled to the knuckle 200 illustrated in FIGS. 2 and 3. The ear pod 104 includes an ear pod base 402, and an ear pod cover 404. The ear pod cover 404 includes an opening 406 through which at least a portion of the knuckle 200 can extend. The opening 406 is sized, so as to allow the first end 202 of the knuckle 200 to pass through the opening 406, but not the second end 208. In effect the second end 208 of the knuckle 200 can be captivated within the ear pod 200 by preventing the end from being able to pass through the opening 406.

Figure 5:
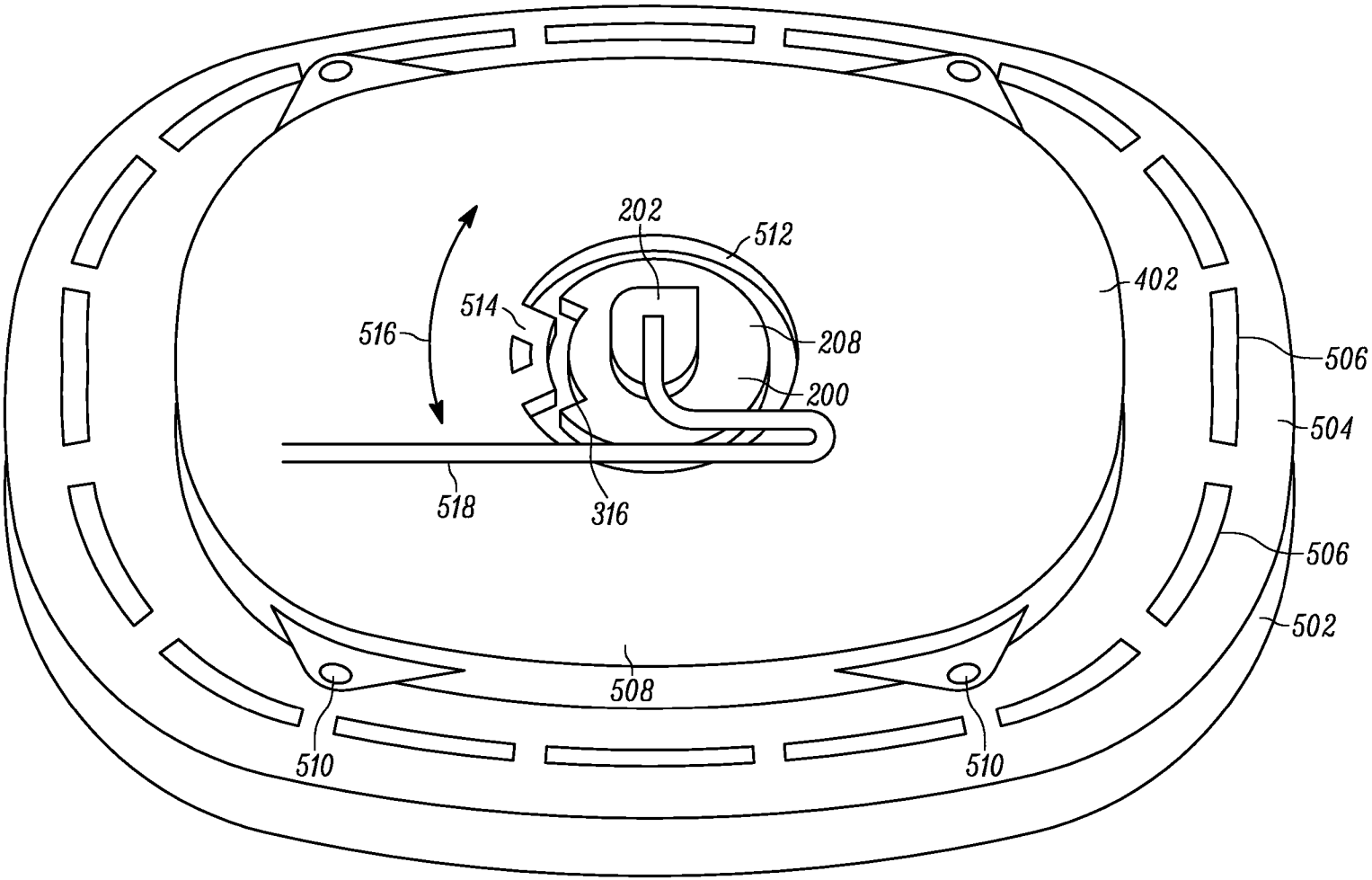
FIG. 5 is a perspective view of an ear pod base, and the knuckle illustrated in FIGS. 2 and 3.

FIG. 5 illustrates a perspective view of the ear pod base 402, and the knuckle 200 illustrated in FIGS. 2 and 3. In at least the illustrated embodiment, the base will include a rubberized or foam-like material 502 that forms the surface that interacts with the head of the user 100. The ear pod base 402 includes a substrate 504 having ridges 506, that facilitates attachment of the rubberized or foam-like material 502. The ear pod base 402 further includes an internal dome 508, which couples to the substrate 504 via a plurality of fasteners 510. Together, the internal dome 508 and substrate 504 create an internal space within which a sound producing element 602, such as a transducer can be located, as well as any circuitry 604 for receiving and converting an electrical signal into an audio signal (see FIG. 6). The internal dome 508 additionally includes a depression 512 within which the second end 208 of the knuckle 200 can be received.

The internal dome 508 still further includes a protrusion 514, which is located to coincide with the notch 316 of the knuckle 200, when the second end 208 of the knuckle 200 is received within the depression 512. The notch 316 of the knuckle 200 relative to protrusion 514 is sized so as to allow the knuckle a finite amount of rotational movement 516 relative to the ear pod 104. In at least some embodiments, the size relationship of the protrusion 514 relative to the notch 316, includes a protrusion, which is smaller than the notch. In at least some instances, this can allow between 3 and 5 degrees of relative rotation. Although the specific amount of allowed rotation can be changed as desired by altering the size of the notch and the corresponding protrusion. A wire 518 is additionally shown extending from the pathway 212 at the first end 202 of the knuckle 200.

Figure 6:
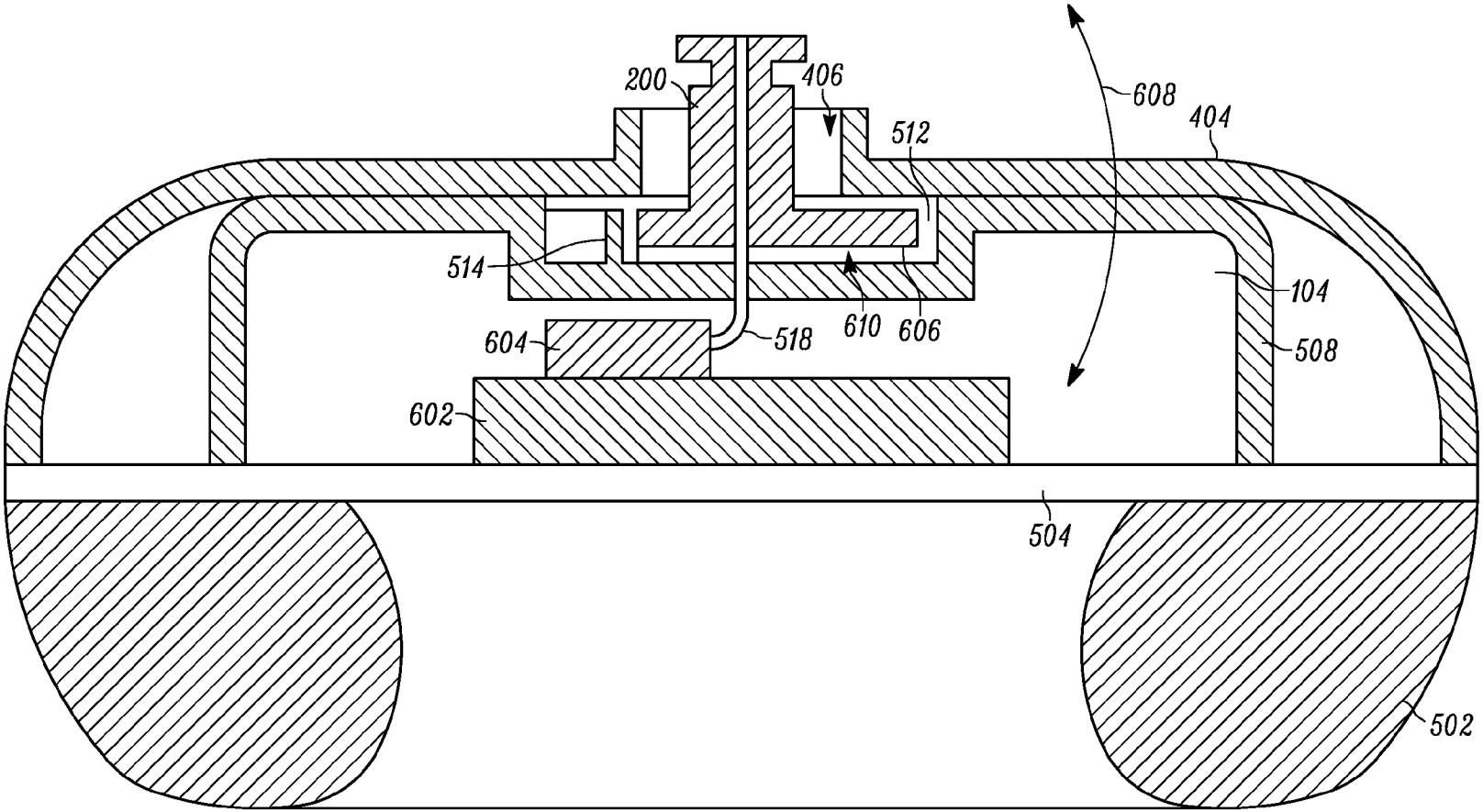
FIG. 6 is a cross sectional side view of the ear pod and knuckle, illustrated in FIG. 4.

FIG. 6 illustrates a cross sectional side view of the ear pod 104 and knuckle 200, illustrated in FIG. 4. In addition to the rubberized or foam-like material 502 and internal dome 508 of the ear pod base 402, the cross sectional side view also illustrates an ear pod cover 404. As previously noted, the ear pod cover 404 has an opening 406, which is of a size so that the first end 202 of the knuckle 200 can extend therethrough. The second end 208 of the knuckle 200, and more specifically the portion having the larger diameter $D_4$ (see FIG. 2) is too large to traverse the opening 406. When the second end 208 of the knuckle 200 is captivated between the depression 512 of the internal dome 508 and the ear pod cover 404. In at least some instances, there is sufficient space 610 between the end facing 606 of the second end 208 of the knuckle 200 and the depression 512 of the internal dome 508 to allow the knuckle to be selectively tilted 608, in addition to the previously discussed rotation 516. The specific amount of allowable tilt can be adjusted as desired by controlling the size of the space between the end facing 606 of the knuckle 200 and the surface of the depression 512.

Figure 7:
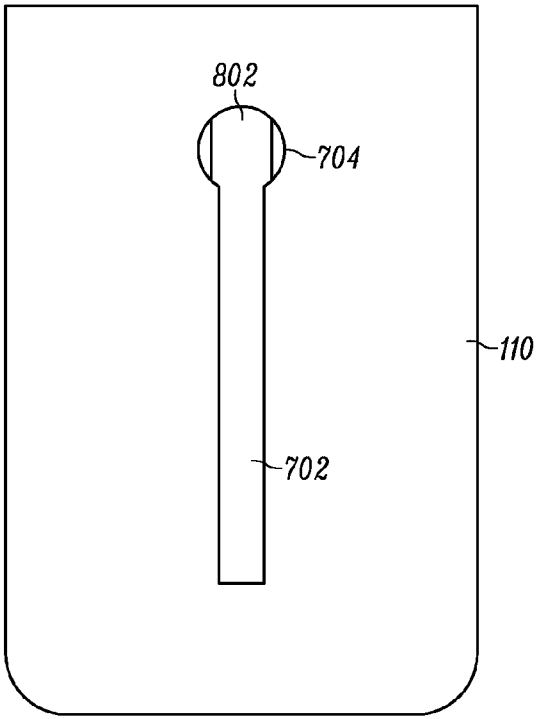
FIG. 7 is an external view of an inward facing headband end cover.

FIG. 7 illustrates an external view of an inward facing headband end cover 110. The headband end cover 110 in the illustrated embodiment is intended to attach to the end of the headband 106 on the side that faces inward toward the head of the user 100. The headband end cover 110 includes a slot 702 and a keyhole 704 at one end of the slot 702. In the illustrated embodiment, the keyhole 704 is located at the top end of the slot 702. Edges of a backing bar 802 located on the backside of the headband end cover 110 can be seen through the keyhole 704. The keyhole 704 is sized to allow the larger diameter $D_2$ (see FIG. 2) of the first end 202 of the knuckle 200 to pass through, but the larger diameter $D_2$ is not large enough to permit the first end 202 of the knuckle 200 to pass through the slot 702, when the knuckle is slid away from the end having the keyhole 704. However, the relatively smaller diameter $D_1$ (see FIG. 2) of the knuckle is small enough to travel along the slot 702.

Figure 8:
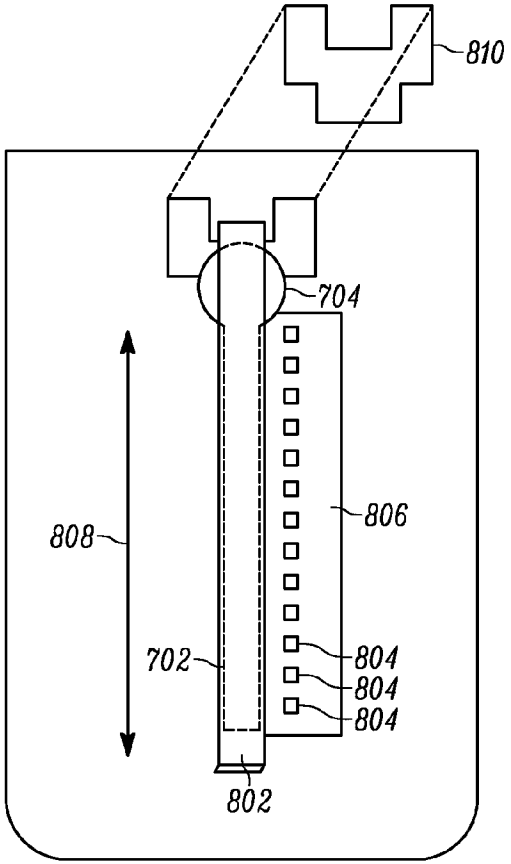
FIG. 8 is an internal view of the inward facing headband end cover.

FIG. 8 illustrates an internal view of the inward facing headband end cover 110. The internal view more clearly illustrates the backing bar 802. A row of teeth 804 is located along one side of the backing bar 802. In the illustrated embodiment, the row of teeth 804 are protrusions extending from the illustrated internal surface of the headband end cover, which can be integrally formed with the same material forming the end cover. The illustrated embodiment further includes a compressible insert 806, which has openings through which the row of teeth can extend. The compressible insert 806 can be made from a rubberized material, a stiff foam material, or any other material that can provide a frictional resistance when compressed.

As noted previously, the first end 202 of the knuckle 200 can be received through the keyhole 704. Once received, the diameter $D_1$ (see FIG. 2) allows the knuckle to travel 808 along the slot 702 away from the keyhole 704 with the first end being captivated by the headband end cover 110 within the slot 702. After the knuckle 200 is received within the slot 702 and moved away from the keyhole 704, a cover 810 can be positioned over the keyhole 704 to limit the ability of the first end 202 of the knuckle 200 from being able to disengage from the slot 702. The slot 704 allows the knuckle 200 to be slidably coupled to the headband 102. Furthermore the compressible insert 806 allows the friction between the knuckle 200 and the headband end cover 110 to be better controlled. The row of teeth 804 are positioned so as to interact with the squared off corner-like 322 contour of the knuckle 200. This interaction can provide for a clicking sound, as the knuckle 200 moves along the slot 702, as well as several adjustable locations along the slot 702, where the position of the knuckle 200 can be better maintained. In the illustrated embodiment, when the knuckle is coupled to both the head band 106 and the ear pod 104, the ear pod 104 is large enough to generally cover the slot 702 regardless of the location of the knuckle 200 along the length of the slot 702.

Figure 9:
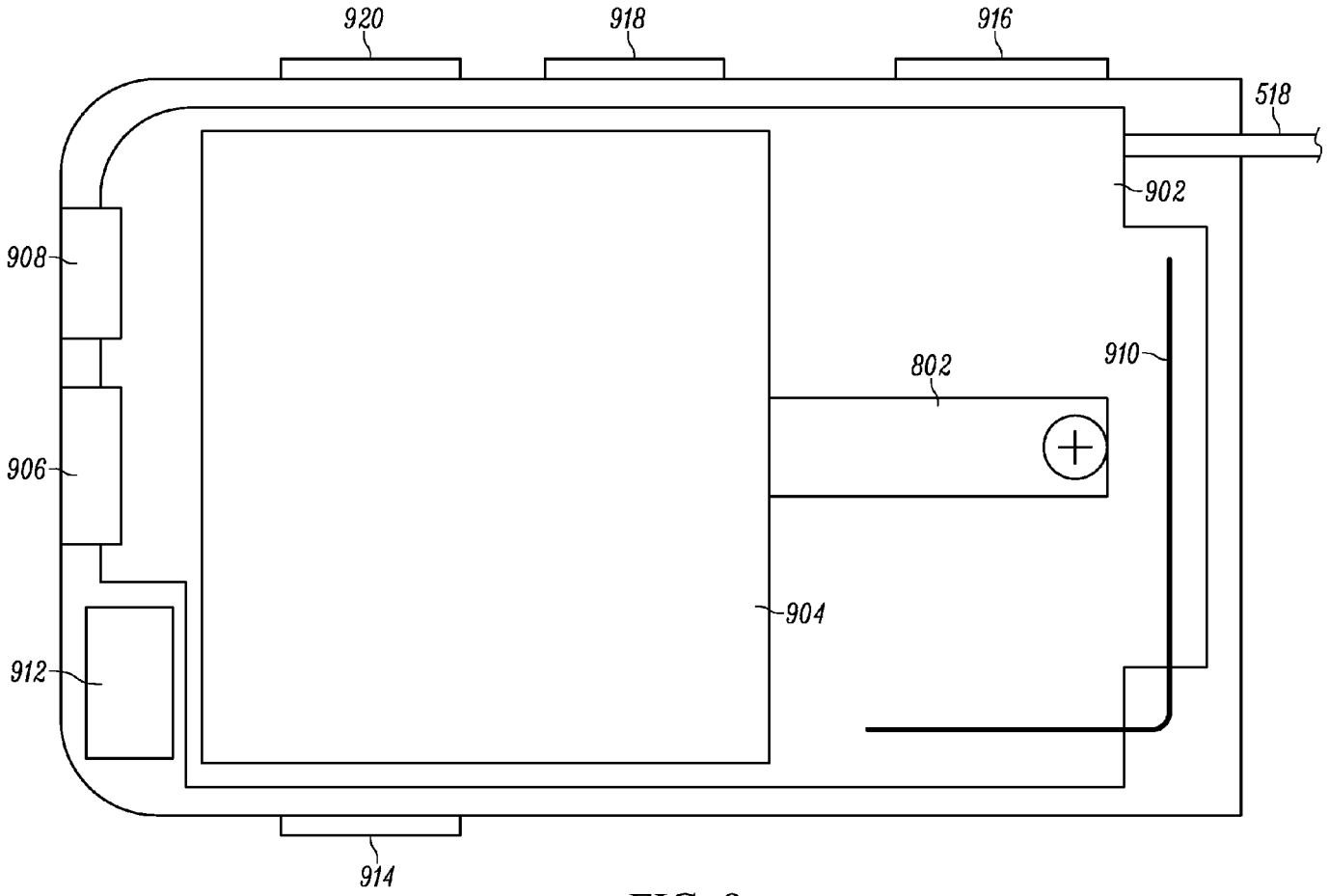
FIG. 9 is an internal view of the headband end cover with circuitry.

FIG. 9 illustrates a further internal view of the headband end cover 110 which includes additional circuitry. The additional circuitry can include control circuitry, power, transmission circuitry, porting, as well as user interface elements. More specifically, in the illustrated embodiment, a circuit board 902 can be received over and around the backing bar 802. The circuit board can provide for a substrate which can receive the circuit elements for supporting the operation of the headphone device 102, as well as the related connectivity for supporting the operation of the same. In addition to the circuit board, a battery 904 for purposes of providing power to the circuitry is provided. The battery 904 can be charged through a charging port 906. An additional audio jack port 908 is provided, which can support a wired audio signal connection. A wireless audio signal connection can be supported through a short range radio transceiver circuitry and corresponding antenna 910. At least one example of a type of suitable short range radio communication for conveying a wireless audio signal includes a Bluetooth®-type connection.

In the illustrated embodiment, the additional circuitry also supports a microphone 912, and a plurality of user interface buttons. The user interface buttons include a power button 914, a multifunction select button 916, and up and down buttons 918 and 920. The up/down button could be used to control the volume of the reproduced sound. The multifunction select button could be used to answer or end a call associated with a paired device.

Wire 518 can support communicative coupling between a pair of ear pods 104, which in turn can result in the additional circuitry being needed in only one of the two headband end covers 110. The other headband end cover 110, that does not have any additional circuitry, can be outfitted to include a dummy weight commensurate with the weight of the additional circuitry to maintain balance between both ends of the headband 106.

Figure 10:
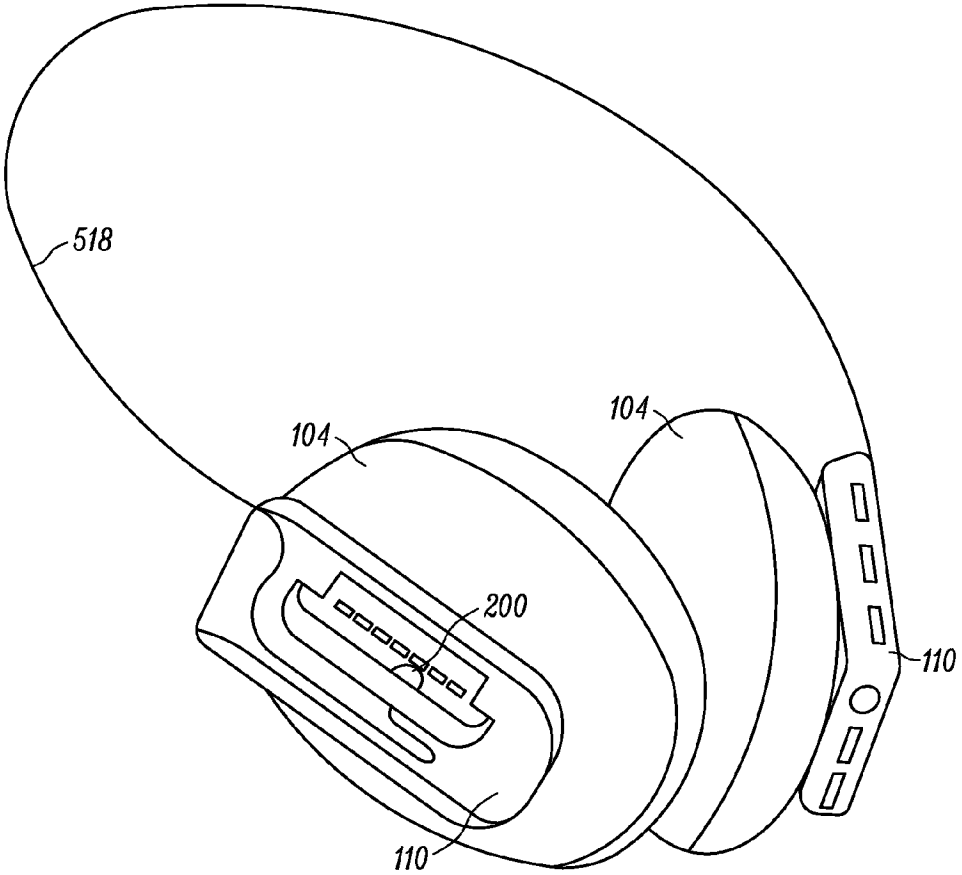
FIG. 10 is a perspective view of a pair of ear pods coupled to a pair of headband end covers and interconnecting wire.
Figure 11:
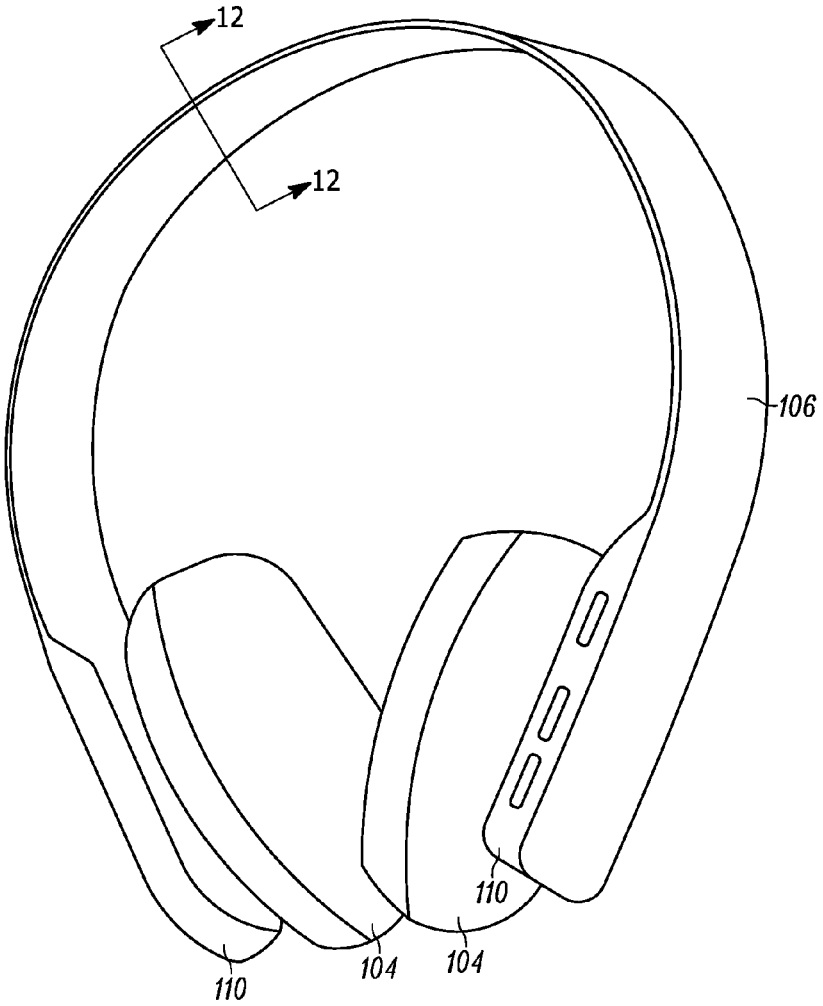
FIG. 11 is a perspective view of a head phone set.
Figure 12:
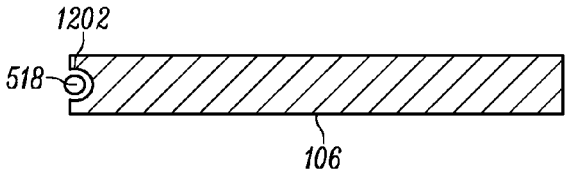
FIG. 12 is a cross sectional view of the headband body with edge groove for receiving the interconnecting wire.

FIG. 10 illustrates a perspective view of a pair of ear pods 104 coupled to a pair of headband end covers 110 and interconnecting wire 518. FIG. 11 illustrates a perspective view of a head phone set after the main headband portion 106 has been added and coupled to the respective headband end covers 110. The wire 518 fits within a groove 1202 located at one edge of the headband 106. FIG. 12 illustrates a cross sectional view of the headband body 106 with edge groove 1202 for receiving the interconnecting wire 518.

In this way an adjustable headphone device 100 can be provided, which does not require a headband having an adjustable length, but instead allows the ear pods 104 to slidably couple to the headband 106 at different points along a slot 702 via a joint including a knuckle. The knuckle 200 facilitates a slidable coupling with the headband 106, and a rotational coupling with an ear pod 104, which in addition to the rotational coupling can also be extended to support an amount of tilt adjustment.

Furthermore, such a design can support a more aesthetically pleasing one piece outer headband construction, where the entire outer surface can be clean, seamless and/or unbroken.

While the preferred embodiments of the invention have been illustrated and described, it is to be understood that the invention is not so limited. Numerous modifications, changes, variations, substitutions and equivalents will occur to those skilled in the art without departing from the spirit and scope of the present invention as defined by the appended claims.

What is claimed is:

1. A headphone device comprising:

a headband; and one or more ear pods, each of said ear pods is coupled to the headband via a joint, the joint including a knuckle having a first end and a second end, where the first end of the knuckle is slidably coupled to the headband, and the second end of the knuckle is rotatably coupled to the respective ear pod; and wherein the headband includes a respective slot within which the first end of each of the knuckles is received and along which the knuckle travels; and wherein the knuckle proximate the first end has a varying diameter, wherein the size of the diameter at the first end of the knuckle closer to the center of the knuckle is smaller than the width of the slot in the headband, and wherein the size of the diameter of the knuckle at the first end of the knuckle farther away from the center of the knuckle is larger than the width of the slot in the headband.

2. A headphone device in accordance with claim 1, wherein the one or more ear pods includes a pair of ear pods, each ear pod being coupled to the headband at respective opposite ends of the headband via a corresponding slot located proximate the respective opposite end of the headband.

3. A headphone device in accordance with claim 2, wherein the slot extends from a respective end of the headband in a direction substantially parallel to and along a length of the headband.

4. A headphone device in accordance with claim 1, wherein the ear pod is sized, so as to substantially cover the slot through an anticipated full range of movement of the knuckle within the slot.

5. A headphone device in accordance with claim 1, wherein the second end of the knuckle is captivated within a space inside the ear pod.

6. A headphone device in accordance with claim 5, wherein the space inside the ear pod is formed between an ear pod base and an ear pod cover.

7. A headphone device in accordance with claim 6, wherein the knuckle proximate the second end has a varying maximum outer dimension.

8. A headphone device in accordance with claim 7, where a portion of the knuckle captivated within the ear pod has a maximum outer dimension that is greater than a size of a hole in the ear pod cover through which the knuckle extends.

9. A headphone device in accordance with claim 8, wherein the portion of the knuckle captivated within the ear pod has a notch extending from an outer edge of the maximum outer dimension, where the maximum outer dimension is greater than the size of the hole in the ear pod cover, for receiving a protrusion formed in the ear pod base.

10. A headphone device in accordance with claim 9, wherein the notch is larger than the protrusion, thereby allowing the knuckle the ability to rotate relative to the ear pod base about an axis of rotation substantially perpendicular to the headband at the point of coupling.

11. A headphone device in accordance with claim 6, wherein the knuckle at the second end has an end facing which, when the knuckle is rotatably coupled to the ear pod, has a gap between the end facing of the second end of the knuckle end and the ear pod base, wherein the gap allows the ear pod to tilt relative to the knuckle.

12. A headphone device in accordance with claim 1, wherein the slot includes a keyhole adapted for receiving a portion of the knuckle at the first end of the knuckle having a diameter that is larger than the width of the slot in the headband.

13. A headphone device comprising:

a headband; and one or more ear pods, each of said ear pods is coupled to the headband via a joint, the joint including a knuckle having a first end and a second end, where the first end of the knuckle is slidably coupled to the headband, and the second end of the knuckle is rotatably coupled to the respective ear pod; and wherein the headband includes a respective slot within which the first end of each of the knuckles is received and along which the knuckle travels; and wherein the headband has a row of teeth proximate and parallel to the slot in the headband for selectively interacting with the knuckle as the knuckle slides within and along the length of the slot, wherein the teeth restricts the slidable movement of the knuckle relative to the headband while the knuckle is located within the slot.

14. A headphone device in accordance with claim 13, wherein the portion of the knuckle, which selectively interacts with the row of teeth includes the part of the knuckle at the first end having a diameter that is larger than the width of the slot.

15. A headphone device in accordance with claim 1, wherein the knuckle includes a hole through which a wire for making electrical connection is routed.

16. A headphone device in accordance with claim 15, wherein the wire is adapted to carry at least one of power or electronic signaling between separate respective ear pods.

17. A headphone device in accordance with claim 16, where in addition to carrying at least one of power and electrical signaling between the separate respective ear pods, the wire additionally routes the at least one of power and electrical signaling along the length of the headband.

18. A headphone device in accordance with claim 17, where the headband additionally includes a groove along an edge of the headband for receiving at least a portion of the wire adapted for carrying at least one of power and electrical signaling between the separate respective ear pods along the length of the headband.

19. A knuckle for facilitating an adjustable connection between an ear pod and a headband of a headphone device, the knuckle comprising:

a first end slidably coupled to the headband, the first end being adapted for being received within and traveling along a slot in the headband; and a second end rotatably coupled to the ear pod proximate the point along the slot that the first end of the knuckle is currently located; and wherein the knuckle includes a hole through which a wire for making electrical connection is routed.

* * * * *